United States Patent [19]

Komossa et al.

[11] Patent Number: 4,640,059

[45] Date of Patent: Feb. 3, 1987

[54] APPARATUS FOR GRINDING THE KNIVES IN TOBACCO CUTTING MACHINES

[75] Inventors: Werner Komossa, Börnsen; Nikolaus Häusler, Wohltorf; Uwe Elsner, Dassendorf, all of Fed. Rep. of Germany

[73] Assignee: Hauni-Werke Körber & Co. KG., Hamburg, Fed. Rep. of Germany

[21] Appl. No.: 708,266

[22] Filed: Mar. 5, 1985

[30] Foreign Application Priority Data

Mar. 14, 1984 [DE] Fed. Rep. of Germany ..... 3409266

[51] Int. Cl.[4] ..... B24B 19/00; B24B 53/07

[52] U.S. Cl. ..... 51/5 D; 51/56 R; 51/249; 83/174; 125/11 DF

[58] Field of Search ..... 51/5 B, 5 D, 56 R, 123 R, 51/209 S, 247, 248, 249, 285, 165 R, 165.8, 165.81, 165.84; 83/174, 174.1; 241/101.2; 125/11 R, 11 DF

[56] References Cited

U.S. PATENT DOCUMENTS

| | | | |
|---|---|---|---|
| 831,541 | 9/1906 | Davis | 51/56 |
| 2,304,647 | 12/1942 | Lehman | 51/56 |
| 2,770,925 | 11/1956 | Wallace et al. | 125/11 R |
| 2,998,676 | 9/1961 | Hawkins | 51/123 R X |
| 3,026,655 | 3/1962 | Osenberg | 51/209 R |
| 3,073,690 | 1/1963 | Hollis et al. | 125/11 R X |
| 3,748,786 | 7/1973 | Elsner et al. | 51/5 D |
| 4,037,712 | 7/1977 | Wochnowski | 198/524 |
| 4,149,547 | 4/1979 | Komossa et al. | 131/109 AB |
| 4,254,781 | 3/1981 | Thiek et al. | 131/111 |
| 4,321,773 | 3/1982 | Fleming | 51/249 |
| 4,495,734 | 1/1985 | Rauch | 51/249 |

FOREIGN PATENT DOCUMENTS

| | | | |
|---|---|---|---|
| 11356 | of 1914 | United Kingdom | 51/56 |

*Primary Examiner*—Robert P. Olszewski
*Attorney, Agent, or Firm*—Peter K. Kontler

[57] ABSTRACT

A tobacco shredding machine wherein the cutting edges of orbiting shredding knives are sharpened by the undulate annular surface of a grinding wheel which is reciprocated forwardly and backwards in parallelism with the axis of the holder for the knives and is retracted from the circular path of the cutting edges during each return stroke of its support. The speed of forward movement of the support while the grinding wheel sharpens the cutting edges is such that the support covers during each revolution of the holder a distance which equals or is a whole multiple of the width of an undulation on the grinding surface. The axes of the grinding wheel and of the holder for the knives are located in a common plane.

20 Claims, 3 Drawing Figures

APPARATUS FOR GRINDING THE KNIVES IN TOBACCO CUTTING MACHINES

BACKGROUND OF THE INVENTION

The present invention relates to cutting machines in general, and more particularly to improvements in machines for shredding tobacco or like fibrous materials. Still more particularly, the invention relates to improvements in apparatus for sharpening the cutting edges of orbiting knives on the rotary knife holder in a tobacco shredding or like machine.

Commonly owned U.S. Pat. No. 3,748,786 to Elsner et al. discloses an apparatus for sharpening the orbiting knives in a tobacco shredding machine by means of one or more grinding wheels which have annular grinding surfaces. An advantage of annular grinding surfaces is that their dimensions do not decrease as a result of wear upon the grinding wheel. The orientation of the grinding wheel or wheels in the machine of Elsner et al. is such that the grinding surfaces of such wheels can sharpen only straight cutting edges. However, it is presently preferred to employ shredding knives with undulate cutting edges because this contributes to the ability of shreds to form tobacco fillers which offer a pronounced resistance to deformation. Such types of smokers' articles are preferred by a large majority of smokers as well as by the manufacturers of cigarettes or the like because of savings in tobacco which is the most expensive constituent of each smokers' product. Thus, a given quantity of tobacco shreds which are obtained by severing tobacco leaves or sheets of reconstituted or substitute tobacco with knives having undulate cutting edges can be converted into a cigarette whose resistance to deformation is much higher than that of a cigarette containing the same quantity of shreds which are obtained in a machine employing knives with straight cutting edges.

OBJECTS AND SUMMARY OF THE INVENTION

An object of the invention is to provide a novel and improved apparatus which can impart to the cutting edges of shredding knives an undulate profile or which can sharpen undulate cutting edges without changing their profiles.

Another object of the invention is to provide a tobacco cutting machine which embodies the improved apparatus.

A further object of the invention is to provide a novel and improved method of sharpening the cutting edges of orbiting knives in a tobacco shredding machine.

An additional object of the invention is to provide the improved apparatus with novel means for moving the sharpening tool, especially a grinding wheel, with reference to the holder for the orbiting knives.

Still another object of the invention is to provide an apparatus which can be installed in existing grinding machines employing knives with undulate cutting edges.

A further object of the invention is to provide the apparatus with novel and improved means for compensating for wear upon the cutting edges of the knives and/or upon the sharpening tool.

Another object of the invention is to provide the apparatus with novel and improved means for synchronizing the translatory movements of the sharpening tool with the orbital movements of the knives.

A further object of the invention is to provide a relatively simple, compact and inexpensive sharpening apparatus which occupies little room in a shredding machine and which, with the possible exception of its sharpening unit, need not employ a discrete prime mover.

An additional object of the invention is to provide an apparatus whose sharpening operation remains unchanged even after a prolonged use of its sharpening tool.

The invention is embodied in a machine for cutting tobacco and like fibrous materials (e.g., reconstituted tobacco). The improved machine comprises a rotary knife holder, at least one knife which is mounted on the holder and has a cutting edge, first drive means (e.g., a shaft driven by a variable-speed motor) for rotating the holder about a first axis so that the cutting edge orbits along a circular first path, a mobile support, guide means defining for the support a second path for movement in parallelism with the first axis, a grinding wheel which is mounted on the support for rotation about a second axis and has a grinding surface with annular undulations concentrically surrounding the second axis (such surface is adjacent to the first path during movement of the support along the second path), and second drive means for reciprocating the support along the second path in first and second directions and for moving the support at a speed which is a function of the rotational speed of the holder, at least while the support moves in the first direction. The grinding wheel can resemble a cup and includes a tubular portion having an end face which constitutes the grinding surface. The distance which the support covers during movement along the second path in the first direction per revolution of the holder is n times m wherein n is a whole number including one and m is the width of an undulation on the grinding surface, as considered radially of the grinding surface. The first and second axes are preferably located in a common plane and the grinding surface is in a substantially linear contact with the elongated cutting edge of the knife once during each revolution of the holder. The region of such linear contact extends substantially radially of the grinding surface and that portion of the grinding surface which is in contact with the cutting edge has a component of movement which is tangential to the first path.

The machine preferably further comprises a dressing apparatus which is mounted on the support and has a dressing tool, means for moving the tool into and out of engagement with the grinding surface, and means for actuating the moving means in at least one predetermined position of the support during each movement of the support along the second path back and forth between two end positions. The dressing tool can include a plate which has an undulate dressing surface.

The second drive means comprises means for reciprocating the support along the second path between first and second end positions and the support assumes the second end position when it completes a movement in the first direction. The machine preferably further comprises first displacing means for shifting the grinding wheel relative to the support in a direction away from the first path when the support reaches the first end position so that the grinding wheel is out of contact with the cutting edge during return movement of the support from the second to the first end position, and second displacing means for shifting the grinding wheel relative to the support in a direction toward the first path when the support reaches the second end position so as to move the grinding surface closer to the first path. A third displacing means can be provided to shift the grinding wheel through a predetermined distance so as to compensate for the wear upon the grinding wheel and on the cutting edge. Such third displacing means is employed if the distance through which the first displacing means shifts the grinding surface away from the first path is the same as the distance through which the second displacing means shifts the grinding surface toward the first path. At least one of the displacing means can comprise a stationary cam which is adjacent to the second path and follower means which is movable with or independently of the grinding wheel but relative to the support and tracks the corresponding cam in the respective end position of the support. The third displacing means is preferably designed to shift the grinding wheel relative to the support in or close to the first end position of the support.

The grinding wheel is preferably mounted on a carriage which is reciprocable with reference to the support at right angles or another angle to the first axis. The means for moving the carriage relative to the support can include a feed screw which is mounted in the support and a nut which is movable with the carriage and mates with the feed screw. Each of the first and second displacing means can comprise follower means which is turnable with the nut about the axis of the feed screw and at least one stationary cam adjacent to the second path and located in the path of movement of the respective follower means. The first and second displacing means can have common follower means, and the third displacing means preferably comprises follower means rotatable with the feed screw and at least one stationary cam adjacent to the second path and located in the path of movement of the follower means which is rotatable with the feed screw so that the latter changes its angular position relative to the nut and thereby shifts the carriage at right angles or at another angle to the first axis whenever the follower means of the third displacing means engages the respective cam. A freewheel can be interposed between the follower means of the third displacing means and the feed screw to ensure that the feed screw can be rotated by the follower means only when the latter is caused to move in one direction about the axis of the feed screw. As mentioned above, the third displacing means compensates for wear upon the grinding wheel and/or upon the cutting edge.

The novel features which are considered as characteristic of the invention are set forth in particular in the appended claims. The improved sharpening apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
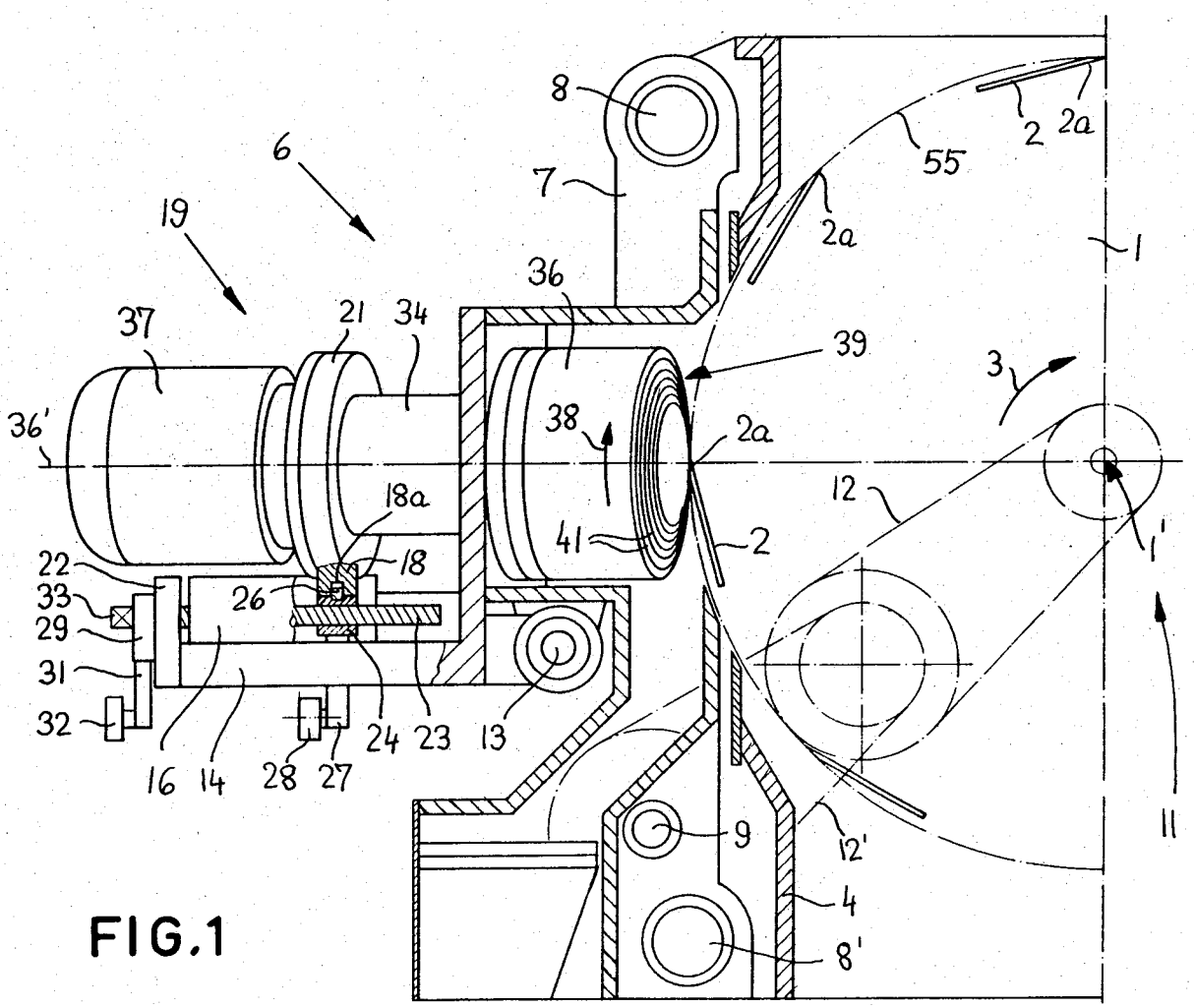
FIG. 1 is a fragmentary partly elevational and partly vertical sectional view of a cutting machine having a sharpening apparatus which embodies the invention, a portion of the holder for a set of equidistant elongated knives being indicated by phantom lines.
Figure 2:
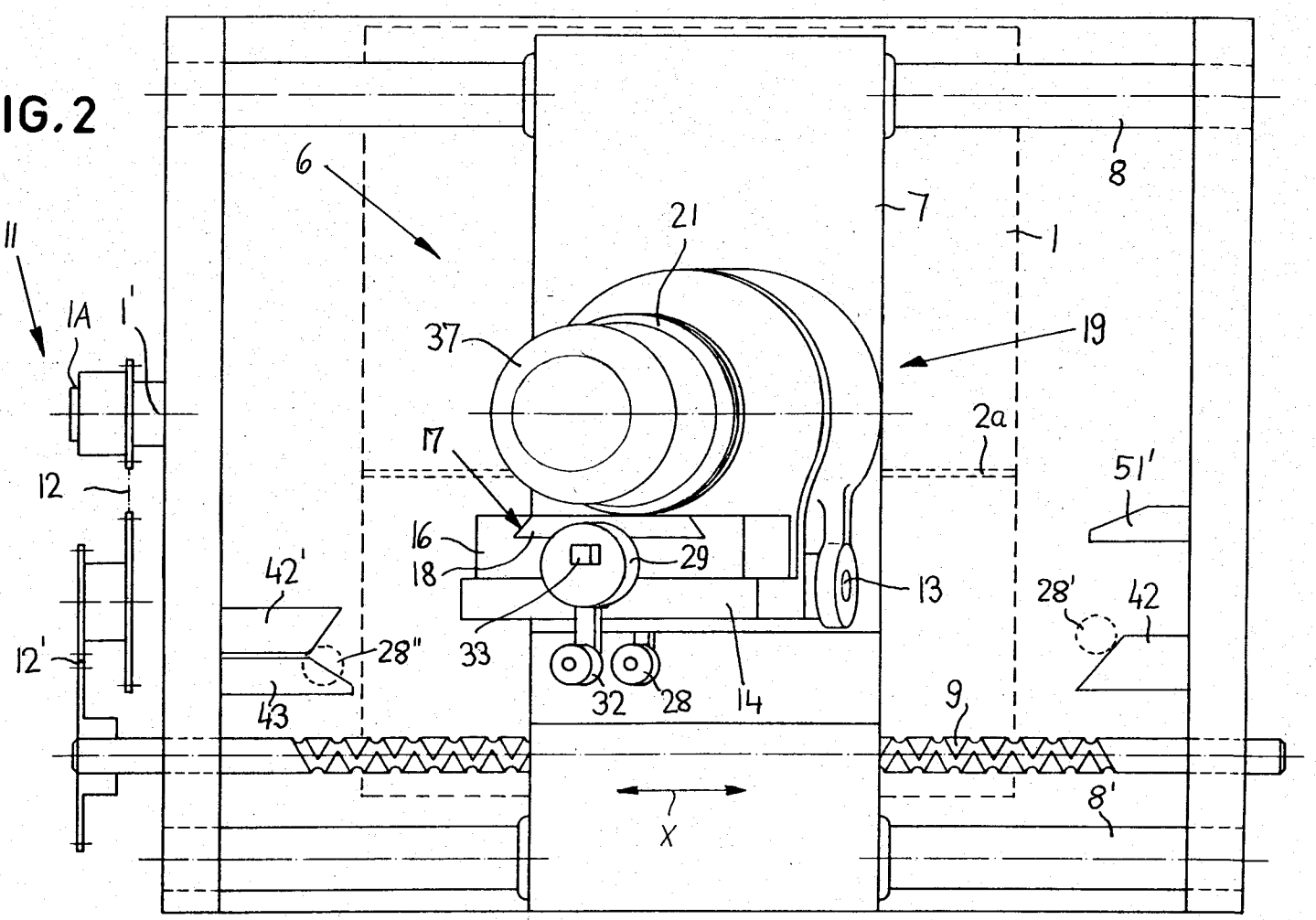
FIG. 2 is a front elevational view of the machine as seen from the left-hand side of FIG. 1.
Figure 3:
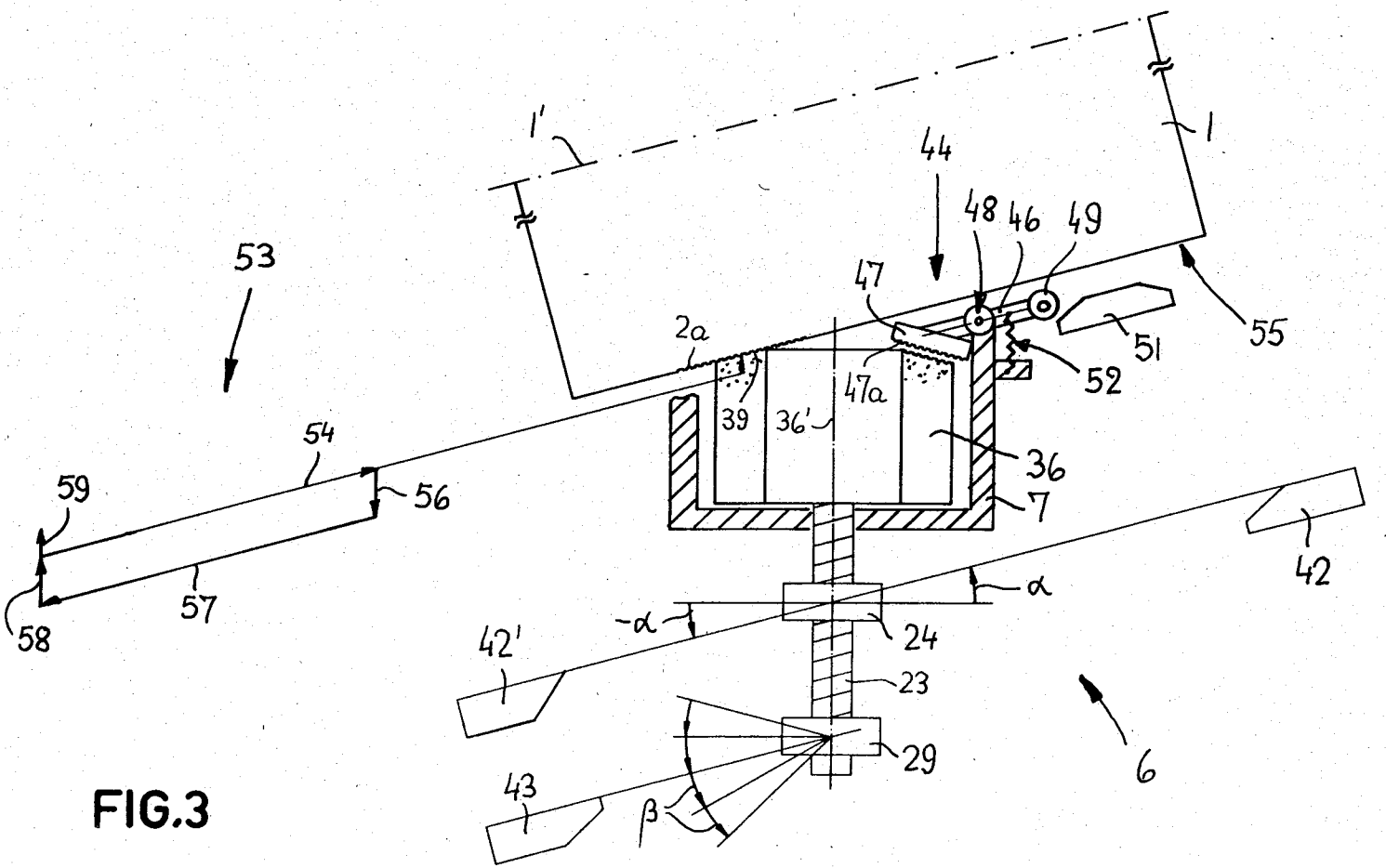
FIG. 3 is a fragmentary schematic plan view, the reciprocable support for the grinding wheel and its carriage being shown in a horizontal sectional view.

The machine of FIGS. 1 to 3 is used for shredding tobacco leaves or like fibrous materials and can be of the type described and shown in commonly owned U.S. Pats. Nos. 4,037,712, 4,149,547 and 4,254,781. The invention is embodied in that part of the machine which includes means for sharpening the knives 2 which are mounted on a rotary holder 1 and are treated by a grinding wheel 36. A knife with an undulate cutting edge is disclosed in commonly owned copending patent application Ser. No. 561,177 filed Dec. 14, 1983 by Elsner.

The holder 1 is rotated by a first drive means 11 including a shaft 1A which is driven by a variable-speed electric motor or another suitable prime mover such as the variable-speed electric motor 9 which is shown in FIG. 1 of U.S. Pat. No. 4,037,712 and whose speed is a function of the mass of tobacco leaves in a duct upstream of the severing station. The severing station is located to the right of the common axis 1' of the shaft 1A and holder 1, as viewed in FIG. 1, and the holder carries a set of equidistant knives 2 each of which has an elongated cutting edge **2*a* extending in substantial parallelism with the axis 1'. When the shaft 1A drives the holder 1 and the knives 2, the cutting edges 2*a* travel along a circular path which is denoted in FIG. 1 by a phantom-line circle 55. The direction in which the holder 1 is rotated is indicated by the arrow 3**.

The aforementioned severing station is located diametrically opposite a second station where the cutting edges **2*a* of the knives 2 are sharpened on their way back toward the severing station. This ensures that the cutting edges 2*a* can predictably sever the so-called cake of condensed tobacco leaves which is fed into their path 55** of orbital movement by two chains or by other suitable conveyors in a manner as fully described and shown in the aforementioned patents.

The machine comprises a housing 4 for the holder 1 and its knives 2 as well as for an apparatus 6 which serves to sharpen the knives 2 in accordance with the present invention. The apparatus 6 comprises a mobile support 7 which is reciprocable along a path defined by elongated guide means in the form of parallel tie rods 8 and 8' whose axes are parallel to the axis 1' of the holder 1. The drive means for reciprocating the support 7 between two spaced-apart end positions and along the path which is defined by the tie rods 8 and 8' comprises a chain drive 12 which receives motion from the shaft 1A, a toothed belt transmission 12' which receives torque from the chain drive 12, a multiple-return cylinder 9 which is rotatably journalled in the housing 4 and is driven by the transmission 12', and suitable follower means (e.g., a sphere) provided on the support 7 and tracking the endless cam groove in the periphery of the cylinder 9. A multiple-return cylinder which can be used in the drive means for the support 7 is known as Norco and is manufactured by Walter Flender, Düsseldorf, German Federal Republic. The cylinder 9 cooperates with the follower means to automatically reverse the direction of reciprocatory movement of the support 7 whenever the latter reaches the one or the other end position. The chain drive 12 can be replaced with a toothed belt transmission or with any other suitable torque transmitting means, and the transmission 12' can be replaced with a gear train or the like without departing from the spirit of the invention. All that counts is to ensure that the speed of reciprocatory movement of the support 7 in at least one of the two directions indicated in FIG. 2 by a double-headed arrow X is a function of the rotational speed of the holder 1. The manner in which the two speeds are related to each other will be explained hereinafter.

The support 7 includes a horizontal shaft 13 which is parallel to the tie rods 8, 8' and defines a pivot axis for a substantially L-shaped bracket 14 which forms part of the support and comprises a dovetailed guide 17 extending substantially transversely of the axis 1' and engaging with a complementary portion of a carriage 18. The latter has an upwardly extending platen 21 which supports a sharpening unit 19 here shown as a grinding head.

The means for moving the carriage 18 along the guide 17 of the support 7 at an oblique angle to the axis 1' of the holder 1 comprises an elongated feed screw 23 which is rotatable in a bearing block 16 of the bracket 14 as well as in a plate-like member 22 secured to the horizontal leg of the bracket 14. The feed screw 23 mates with a nut 24 which is turnable about the axis of the feed screw and has a tongue 26 extending into a complementary slot 18*a* of the carriage 18 so that the nut 24 can perform pendular movements about the axis of the feed screw 23 and relative to the carriage 18 but the latter is compelled to share all movements of the nut 24 in the axial direction of the feed screw. The nut 24 has an arm 27 which extends substantially radially of the feed screw 23 and whose lower end portion carries a roller follower 28 forming part of two displacing devices and cooperating with two stationary cams 42, 42' which are mounted in the housing 4 adjacent to the path of reciprocatory movement of the support 7 along the tie rods 8 and 8'. The displacing devices including the roller follower 28 and cams 42, 42' serve to move the carriage 18 and the sharpening unit 19 through a predetermined distance in a direction away from and toward the circular path 55 once during each phase of reciprocatory movement of the support 7. Each such phase includes a movement of the support 7 in a first direction from a first end position (to the left of the position shown in FIG. 2) to a second end position and back to the first end position. The roller follower 28 can turn the nut 24 clockwise or counterclockwise whereby the carriage 18 moves toward or away from the circular path 55.

The feed screw 23 can be caused to change its angular position by a freewheel 29 which is mounted on the member 22 and can receive motion from an arm 31 carrying at its lower end a roller follower 32 forming part of another displacing device which further includes a stationary cam 43 mounted in the housing 4 adjacent to the path of movement of the support 7. The arrangement is such that the freewheel 29 rotates the feed screw 23 when the arm 31 is pivoted in one direction but that the feed screw 23 does not change its angular position when the arm 31 pivots in the opposite direction. In the illustrated embodiment, the arm 29 is caused to rotate the feed screw 23 during pivotal movement in a direction to move the roller follower 32 from a lower level to a higher level but the feed screw 23 need not rotate with the arm 31 when the latter returns the follower 32 to the lower level. The accessible front end portion 33 of the feed screw 23 has a polygonal (e.g., square) outline so that it can be engaged by a wrench or another suitable tool when the operator wishes to change the angular position of the feed screw 23 (and hence the distance between the nut 24 and the circular path 55) independently of the follower 28 and/or 32.

The sharpening unit 19 on the carriage 18 comprises a horizontal spindle 34 which transmits torque from an electric motor 37 to the grinding wheel 36. The latter resembles a cup having a tubular (preferably cylindrical) portion whose annular front end face 39 (namely the end face which faces the holder 1) constitutes a grinding surface for the cutting edges 2*a* of the knives 2. The grinding surface 39 is provided with a plurality of concentric annular undulations 41. The grinding surface 39 of the illustrated grinding wheel 36 resembles the frustum of a cone. The spindle 34 is rotatably journalled in the platen 21 of the carriage 18. The direction in which the motor 37 can drive the grinding wheel 36 about an axis 36' which is coplanar with and intersects the axis 1' is indicated by the arrow 38.

FIG. 3 shows schematically a dressing apparatus 44 for the surface 39 of the grinding wheel 36. The apparatus 44 comprises a two-armed lever 46 the left-hand arm of which carries a plate-like or tile-like dressing tool 47 having an undulate dressing surface 47*a* defined by diamonds which remove material from the grinding surface 39 when the lever 46 is pivoted in a counterclockwise direction, as viewed in FIG. 3, against the opposition of a coil spring 52 which tends to maintain the surface 47*a* out of contact with the grinding surface 39. The lever 46 is pivotable about the axis of a pin 48 which is mounted on the support 7. The means for moving the tool 47 into and away from engagement with the grinding surface 39 comprises a roller follower 49 on the right-hand arm of the lever 46 and a stationary cam 51 which is mounted in the housing 4 adjacent to the path of movement of the support 7 along the tie rods 8 and 8'.

The operation of the sharpening apparatus 6 is as follows:

FIG. 3 shows the grinding wheel 36 in its operative position in which a portion of the grinding surface 39 is in linear contact with the cutting edges 2*a* of successive knives 2 when the motor which drives the shaft 1A is on so that the holder 1 rotates in the direction of arrow 3. The motor 37 drives the wheel 36 in the direction of arrow 38 at a constant speed. As can also be seen in FIG. 3, that portion of the grinding surface 39 which is in contact with the adjacent cutting edge 2*a* is disposed substantially tangentially of the circular path 55 and sharpens the cutting edges 2*a* so that each such cutting edge has a substantially undulate shape (see FIG. 3). Such portion of the grinding surface 39 has a component of movement tangentially of the circular path 55.

The grinding operation is represented schematically in the diagram 53 of FIG. 3 by the arrow 54 which is parallel to the axis 1' of the holder 1. At such time, the grinding surface 39 is immediately adjacent to the circular path 55 and the cylinder 9 cooperates with the follower means of the support 7 to move the latter along the tie rods 8, 8' in a direction to the right, as viewed in FIG. 3. The holder 1 completes a large number of revolutions while the support 7 advances from its left-hand to its right-hand end position, as viewed in FIG. 3. The ratio of rotational speed of the holder 1 (i.e., the speed of the cutting edges 2*a* along the path 55) to the speed of movement of the support 7 and the grinding wheel 36 thereon in a direction from the left to the right, as viewed in FIG. 3, is such that the support 7 covers a distance m or a distance m times n during each revolution of the holder 1. The distance m equals the width of an undulation 41, as considered in the radial direction of the annular grinding surface 39, and n is a whole number including one. Such selection of the just discussed speed ratio ensures that the profile of the grinding surface 39 is accurately transferred onto the cutting edges 2*a* of the knives 2 during the start of the grinding operation upon new cutting edges 2*a* and is accurately restored during each regrinding of the cutting edges 2*a*. This is ensured irrespective of whether n equals one or a whole multiple of one.

The dressing apparatus 44 shares the reciprocatory movements of the support 7 in the directions of arrow X, and the spring 52 normally maintains the dressing tool 47 in the position which is shown in FIG. 3, i.e., out of contact with the grinding surface 39. As the support 7 moves toward its right-hand end position, the follower 49 is caused to ride over the suitably configurated face of the stationary cam 51 which ensures that the lever 46 is pivoted in a counterclockwise direction and moves the undulate surface 47*a* of the dressing tool 47 into material-removing engagement with the undulate surface 39 of the grinding wheel 36. The duration of material-removing engagement between the dressing tool 47 and the grinding wheel 36 is determined by the speed of the support 7 and the length of that portion of the cam 51 which causes the roller follower 49 to stress the spring 52 and to hold the surface 47*a* in actual contact with the surface 39. The orientation of the grinding wheel 36 with reference to the periphery of the holder 1 is such that, if desired or necessary, the tool 47 can be maintained in engagement with the grinding surface 39 for an extended interval of time during the forward and/or during the return stroke of the support 7. In the illustrated embodiment, the cam 51 causes the roller follower 49 to urge the dressing tool 47 against the grinding surface 39 only during a relatively advanced stage of movement of the support 7 to the right-hand end position of FIG. 3 but not during any stage of return movement to the left-hand end position because the nut 24 is caused to shift the grinding wheel 36 away from the circular path 55 as soon as the support 7 is about to reach its right-hand end position. This is accomplished by the displacing device including the roller follower 28 on the arm 27 of the nut 24 and the stationary cam 42. Thus, and as can be readily seen in FIG. 3, the cam 42 causes the follower 28 to turn the nut 24 through the angle alpha while the support 7 is in the process of completing the last stage of its movement to the right-hand end position. This entails a movement of the carriage 18 and sharpening unit 19 in a direction away from the circular path 55 (see the arrow 56 in the diagram 53) so that the grinding surface 39 is spaced apart from the path 55 of orbital movement of the cutting edges 2*a* and remains out of contact with the knives 2 while the cylinder 9 moves the support 7 toward the left-hand end position of FIG. 3 (arrow 57 in the diagram 53). The position of the roller follower 28 during engagement with the cam 42 is shown in FIG. 1 by broken lines, as at 28'. The distance which is denoted by the arrow 56 of the diagram 53 is relatively short, i.e., it can be in the range of a small fraction of one millimeter because the undulations 41 of the grinding surface 39 are not pronounced.

When the support 7 is about to reach its left-hand end position, as viewed in FIG. 3, the roller follower 28 engages the cam 42' and it is moved with the nut 24 about the axis of the feed screw 23 through the angle minus alpha which matches the angle alpha whereby the nut 24 causes the carriage 18 and sharpening unit 19 to move toward the periphery of the holder 1 (see the arrow 58 in the diagram 53) through the same distance as that denoted by the arrow 56 so that, in the absence of any wear upon the grinding surface 39 and/or cutting edges 2*a*, the grinding surface 39 would reassume an optimum position for sharpening of the cutting edges 2*a* while the support 7 again moves toward the right-hand end position of FIG. 3. One of the positions which the roller follower 28 assumes during engagement with the cam 42' is shown in FIG. 1 by the broken-line circle 28''. The angular position of the arm 27 for the roller follower 28 immediately before the roller follower 28 engages the cam 42 is the same as that which the arm 27 assumes immediately after the roller follower 28 becomes disengaged from the cam 42'.

The cam 43 is adjacent to that portion of the path for the support 7 which the latter assumes shortly before it reaches the left-hand end position of FIG. 3, i.e., when the follower 28 tracks the cam 42'. At such time, the follower 32 tracks the cam 43 which causes the feed screw 23 to change its angular position through the angle beta (the freewheel 29 is then operative to transmit torque from the arm 31 to the feed screw 23). This causes the feed screw 23 to shift the nut 24 (and hence the carriage 18 with the sharpening unit 19 including the grinding wheel 36) in a direction toward the axis 1' of the holder 1 so that the feed screw 23 compensates for wear upon the grinding surface 39 and/or cutting edges 2*a*. The direction in which the grinding wheel 36 is moved in response to angular movement of the feed screw 23 through the angle beta is indicated in the diagram 53 by the short arrow 59. The positions of the carriage 18 relative to the support 7 can be read on a suitable scale so that an operator can ascertain the extent of wear upon the knives 2 and/or grinding wheel 36.

The roller follower 28 and the cam 42 constitute a first displacing device which serves to shift the grinding wheel 36 through a predetermined distance in a direction away from the circular path 55, and the roller follower 28 and the cam 42' constitute a second displacing device which can shift the grinding wheel 36 through the same distance as the displacing device 28, 42 but in the opposite direction, i.e., toward the circular path 55. The roller follower 32 and the cam 43 constitute a third displacing device which serves to shift the grinding wheel 36 toward the axis 1' of the holder 1 whenever the support 7 approaches or reaches the left-hand end position of FIG. 3.

As mentioned above, the axes 1' and 36' are located in a common plane and the orientation of the grinding wheel 36 with reference to the periphery of the holder 1 is such that a radially extending portion of the grinding surface 39 is in linear contact with successive cutting edges 2*a* when the sharpening apparatus 6 is in actual use. That portion of the grinding surface 39 which is in linear contact with the adjacent cutting edge 2*a* has a component of movement which is substantially tangential to the holder 1. Such orientation of the grinding wheel 36 with reference to the holder 1 ensures a highly satisfactory transfer of the profile of the grinding surface 39 onto the cutting edges 2*a* of the orbiting knives 2 during initial grinding and the restoring of such profile during each subsequent grinding. Such highly satisfactory transfer of the undulate profile onto the cutting edges 2*a* is further guaranteed by the aforediscussed ratio of rotational speed of the holder 1 to the speed of movement of the support 7 from the left-hand to the right-hand end position of FIG. 3.

The illustrated position of the stationary cam 51 with reference to the path of movement of the support 7 and roller follower 49 is such that the grinding surface 39 is dressed by the tool 47 in the course of the actual grinding operation, i.e., while the support 7 is in the process of moving from the left-hand to the right-hand end position of FIG. 3. However, it is equally possible to locate the cam 51 in such a way that the grinding surface 39 is dressed while it is spaced apart from the circular path 55, i.e., at a time when the grinding wheel 36 is not in the process of sharpening the knives 2. One such position of the cam 51 is shown at 51' in FIG. 2.

The drive means including the cylinder 9 can be replaced with other means for reciprocating the support 7 along the tie rods 8 and 8' in parallelism with the axis 1' of the holder 1. For example, the support 7 can carry a nut meshing with a feed screw which is rotatable by a reversible motor to move the support between its spaced-apart end positions. It is also possible to employ in the drive means for the support 7 suitable transmission means or the like which ensures that the movement of the support from its second position back to the first position (when the grinding wheel is out of contact with the cutting edges of the knives) is faster than the movement from the first to the second position. This guarantees that the intervals during which the grinding wheel 36 is not in a position to grind the knives 2 are shorter than the intervals of actual contact between the grinding surface 39 and successive cutting edges **2*a*. The means which can effect movements of the support 7** at several speeds are well known in the art and need not be described here.

As indicated by the arrow 56 in the diagram 53 of FIG. 3, the cam 42 causes the carriage 18 and the sharpening unit 19 thereon to move in the direction of the axis 36' and away from the circular path 55 upon completion of a grinding operation (i.e., upon completion of a movement of the support 7 from the left-hand to the right-hand end position of FIG. 3. It is equally within the purview of the invention to move the carriage 18 in a different direction, as long as the grinding surface 39 is moved away from the circular path 55. For example, the carriage 18 can be caused to move in the radial direction of the holder 1 and exactly at right angles to the axis 1'. Alternatively, the arrangement may be such that the carriage 18 is movable toward and away from the holder 1 along a path which is inclined relative to the axis 36' of FIG. 3 but is not exactly normal to the axis 1'. This depends on the availability of space in a particular tobacco cutting machine and on the type of equipment which is available or preferred for effecting movements of the grinding wheel 36 toward and away from the circular path 55. Thus, the direction which is indicated by the arrow 56 in the diagram 53 of FIG. 3 is but one of numerous directions in which the carriage 18 can be caused to move in order to disengage the grinding surface 39 from the cutting edges **2*a***.

The tile-like or plate-like dressing tool 47 can be replaced with an otherwise configurated non-rotatable dressing tool (e.g., with a discrete diamond and means for moving the diamond relative to the grinding surface 39) or with a rotary dressing tool. The illustrated dressing tool is preferred at this time because its mounting is simple and there is no need for a motor to drive the dressing tool and/or for complex means to guide the dressing tool along a predetermined path so as to ensure adequate treatment of the entire grinding surface.

The aforedescribed displacing devices including the roller followers 28, 32 and cams 42, 42' and 43 can be replaced with other types of displacing means, e.g., with fluid-operated cylinder and piston units, electric motors and/or others. The illustrated purely mechanical displacing devices are simple, compact and inexpensive as well as highly reliable and require little or no maintenance. The same holds true for the mechanism including the cam 51 and follower 49 for moving the dressing tool 47 relative to the grinding surface 39.

The freewheel 29 ensures that the cam 43 and the roller follower 32 can cooperate to move the carriage 18 and the grinding wheel 36 thereon in a direction toward the circular path 55 for the orbiting cutting edges **2*a* but not in the opposite direction. A suitable spring or a weight can be provided to pivot the arm 31 back to the position of FIG. 2 as soon as the roller follower 32 becomes disengaged from the cam 43 to thus ensure that the roller follower 32 can return to its normal position by moving in a direction such that the arm 31 cannot rotate the feed screw 23 because the freewheel 29 is then incapable of transmitting motion from the arm 31** to the feed screw.

An important advantage of the improved sharpening apparatus and of the machine which embodies such apparatus is that a cupped grinding wheel (i.e., a grinding wheel having an annular grinding surface) can be used to impart to the cutting edges of orbiting shredding knives an undulate profile or to preserve (restore) the undulate profile of such cutting edges. This is desirable and advantageous because the dimensions of the grinding surface 39 remain unchanged even though the axial length of the cylindrical portion of the grinding wheel 36 decreases in response to progressing wear resulting from treatment by the dressing tool 47 as well as from repeated material-removing contact with the cutting edges **2*a*. Absence of any changes in the dimensions of the grinding surface 39 is one of the primary requisites for ensuring a predictable grinding action. Moreover, the grinding wheel 36** can stand a much longer period of use than a standard grinding wheel with a peripheral working surface because it can be used up to a much larger extent while the dimensions of its grinding surface remain unchanged.

Another important advantage of the improved apparatus is that the RPM of the grinding wheel 36 need not be changed with progressing wear upon its surface 39 and that such RPM need not be dependent from or in any way related to the RPM of the holder 1 for the knives 2. Thus, the ratio of the RPM of the grinding wheel 36 to the RPM of the holder 1 can remain constant even though the RPM of the grinding wheel remains unchanged irrespective of the extent of wear upon the grinding wheel.

The shreds which are obtained as a result of severing a tobacco cake with the knives 2 whose cutting edges **2*a*** have undulate profiles are much more satisfactory as concerns the filling power of the fillers of smokers' products which employ such shreds.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a machine for cutting tobacco and like fibrous materials, a rotary knife holder; at least one knife having a cutting edge and being mounted on said holder; first drive means for rotating said holder about a first axis whereby said cutting edge orbits along a circular first path; a mobile support; guide means defining for said support a second path for movement in parallelism with said axis; a grinding wheel mounted on said support for rotation about a second axis, said wheel having a grinding surface with annular undulations concentrically surrounding said second axis and said surface being adjacent to said first path during movement of said support along said second path; second drive means for reciprocating said support along said second path in first and second directions between first and second end positions and for moving said support at a speed which is a function of the rotational speed of said holder, at least while said support moves in said first direction, said support assuming said second end position upon completion of movement in said first direction; first displacing means for shifting the grinding wheel away from said holder when the support reaches or approaches said second end position so that the grinding wheel is out of contact with the cutting edge during movement of the support from the second to the first end position; and second displacing means for shifting the grinding wheel toward the holder when the support reaches or approaches said second end position so as to move said grinding surface closer to said circular path.

2. The structure of claim 1, wherein said grinding wheel includes a tubular portion having an end face which constitutes said grinding surface.

3. The structure of claim 1, wherein the distance which is covered by said support during movement along said second path in said first direction per revolution of said holder is m·n wherein m is a whole number including one and n is the width of an undulation, as considered in the radial direction of said grinding surface.

4. The structure of claim 1, wherein said axes are located in a common plane.

5. The structure of claim 4, wherein said cutting edge is elongated and said grinding surface is in substantially linear contact with such cutting edge once during each revolution of said holder, the region of such linear contact being disposed at least substantially radially of said grinding surface and that portion of said grinding surface which is in contact with the cutting edge having a component of movement which is tangential to said first path.

6. The structure of claim 1, further comprising a dressing apparatus provided on said support and including a dressing tool and means for moving said tool into and from engagement with said grinding surface.

7. The structure of claim 6, further comprising means for actuating said moving means in at least one predetermined position of said support during each movement of said support along said second path back and forth between two end positions.

8. The structure of claim 6, wherein said dressing tool has an undulate dressing surface.

9. The structure of claim 8, wherein said dressing tool includes a plate.

10. The structure of claim 1, wherein each of said displacing means comprises at least one stationary cam and follower means movable with said grinding wheel relative to said support and tracking the respective cam in or close to the corresponding end position of said support.

11. The structure of claim 10, wherein said first displacing means includes means for shifting the grinding wheel away from said holder through a predetermined distance and said second displacing means includes means for shifting the grinding wheel toward said holder through said predetermined distance, and further comprising third displacing means for shifting said grinding wheel toward said holder through a second predetermined distance.

12. The structure of claim 11, wherein said third displacing means comprises a cam and follower means movable relative to said support and arranged to track said cam.

13. The structure of claim 11, wherein said third displacing means is operative to move said grinding wheel in or close to the second end position of said support.

14. The structure of claim 1, further comprising a carriage movable on said support at an angle to said first axis, said grinding wheel being mounted on said carriage.

15. The structure of claim 1, further comprising a carriage for said grinding wheel and means for moving said carriage with reference to said support at an angle to said first axis, said moving means including a feed screw mounted in said support and a nut movable with said carriage relative to said support and mating with said feed screw.

16. The structure of claim 1, wherein said second drive means comprises a multiple return cylinder having an endless groove, means for rotating said cylinder, and follower means provided on said support and tracking said groove.

17. In a machine for cutting tobacco and like fibrous materials, a rotary knife holder; at least one knife having a cutting edge and being mounted on said holder; first drive means for rotating said holder about a first axis whereby said cutting edge orbits along a circular first path; a mobile support; guide means defining for said support a second path for movement in parallelism with said axis; a carriage; means for moving said carriage with reference to said support at an angle to said first axis, including a feed screw mounted in said support and a nut movable with said carriage relative to said support and mating with said feed screw; displacing means for said carriage including cam means adjacent said second path and follower means fixed to said nut and arranged to change the angular position of said nut and hence the position of said carriage relative to said support in response to engagement with said cam means; a grinding wheel mounted on said carriage for rotation about a second axis, said wheel having a grinding surface with annular undulations concentrically surrounding said second axis and said surface being adjacent to said first path during movement of said support along said second path; and second drive means for reciprocating said support along said second path in first and second directions and for moving said support at a speed which is a function of the rotational speed of said holder, at least while said support moves in said first direction.

18. In a machine for cutting tobacco and like fibrous materials, a rotary knife holder; at least one knife having a cutting edge and being mounted on said holder; first drive means for rotating said holder about a first axis whereby said cutting edge orbits along a circular first path; a mobile support; guide means defining for said support a second path for movement in parallelism with said axis; a carriage; means for moving said carriage with reference to said support at an angle to said first axis, including a feed screw mounted in said support and a nut movable with said carriage relative to said support and a mating with said feed screw; displacing means for said carriage including cam means adjacent said second path and follower means turnable with said feed screw relative to said support and said nut to move said carriage relative to said support in response to engagement with said cam means; a grinding wheel mounted on said carriage for rotation about a second axis, said wheel having a grinding surface with annular undulations concentrically surrounding said second axis and said surface being adjacent to said first path during movement of said support along said second path; and second drive means for reciprocating said support along said second path in first and second directions and for moving said support at a speed which is a function of the rotational speed of said holder, at least while said support moves in said first direction.

19. The structure of claim 18, further comprising freewheel means interposed between said feed screw and said follower means so that said follower means can rotate said feed screw in a single direction.

20. In a machine for cutting tobacco or like fibrous materials, a rotary knife holder; at least one knife having a cutting edge and being mounted on said holder; first drive means for rotating said holder about a first axis whereby said cutting edge orbits along a circular first path; a mobile support; guide means defining for said support a second path for movement in parallelism with said axis; a grinding wheel mounted on said support for rotation about a second axis which is inclined with reference to said first axis, said wheel having a grinding surface with annular undulations concentrically surrounding said second axis and said surface being adjacent to said first path during movement of said support along said second path, said grinding wheel including a tubular portion having a substantially conical end face which constitutes said grinding surface, said cutting edge being elongated and said grinding surface being in substantially linear contact with said cutting edge once during each revolution of said holder, the region of such linear contact being disposed substantially radially of said grinding surface and that portion of said grinding surface which is in contact with the cutting edge having a component of movement which is substantially tangential to said first path; second drive means for reciprocating said support along said second path in first and second directions and for moving said support at a speed which is a function of the rotational speed of said holder, at least while said support moves in said first direction, said second drive means being arranged to reciprocate said support along said second path between first and second end positions and said support assuming said second end position upon completion of a movement in said first direction; first displacing means for shifting the grinding wheel away from said holder when the support reaches or approaches said second end position so that the grinding wheel is out of contact with the cutting edge during movement of the support from the second to the first end position; and second displacing means for shifting the grinding wheel toward the holder when the support reaches or approaches said first end position so as to move said grinding surface closer to said circular path.

* * * * *